US008632444B2

(12) United States Patent
McBride et al.

(10) Patent No.: US 8,632,444 B2
(45) **Date of Patent: *Jan. 21, 2014**

(54) PORTABLE WORKOUT APPARATUS HAVING A PIVOTALLY MOUNTED EXERCISE BAR

(75) Inventors: Robert McBride, Springfield, MO (US); Kevin Gerschefske, Springfield, MO (US); Sarah Simpson, Springfield, MO (US)

(73) Assignee: Stamina Products, Inc., Springfield, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/976,367

(22) Filed: Dec. 22, 2010

(65) Prior Publication Data

US 2011/0092348 A1 Apr. 21, 2011

Related U.S. Application Data

(63) Continuation of application No. 11/907,531, filed on Oct. 12, 2007, now Pat. No. 7,878,954.

(51) Int. Cl.
*A63B 21/02* (2006.01)

(52) U.S. Cl.
USPC ..... 482/133; 482/121; 482/123; 482/129; 482/142

(58) Field of Classification Search
USPC ..... 482/23, 24, 33, 38, 39, 91, 92, 95, 96, 482/123, 130, 137, 142–144, 907, 104, 138
See application file for complete search history.

(56) References Cited

U.S. PATENT DOCUMENTS

| | | | | | |
|---|---|---|---|---|---|
| 399,632 | A | * | 3/1889 | Reach | 482/38 |
| 885,240 | A | | 4/1908 | Graham | 285/130.1 |
| 889,223 | A | | 6/1908 | Graham | 52/653.2 |
| 1,104,505 | A | * | 7/1914 | Holworthy | 482/24 |
| 1,261,213 | A | | 4/1918 | Clay | 403/233 |
| 1,570,307 | A | * | 1/1926 | Kirby | 482/66 |
| 2,711,917 | A | | 6/1955 | Blu | 403/171 |

(Continued)

FOREIGN PATENT DOCUMENTS

WO WO 02/24281 3/2002

OTHER PUBLICATIONS

Balanced Body, Inc., "Finely crafted Pilates equipment", 2003 catalog.*

(Continued)

*Primary Examiner* — Loan Thanh
*Assistant Examiner* — Gregory Winter
(74) *Attorney, Agent, or Firm* — Pillsbury Winthrop Shaw Pittman LLP

(57) ABSTRACT

An exercise device is disclosed that is useful for performing various exercises including Pilates exercises. The exercise device includes a pilates tower having first and second sides. A first padded surface extends horizontally from the first side of the pilates tower. The first padded surface pivotally mounts to the pilates tower. A second padded surface extends horizontally from the pilates tower. A third padded surface is removably attached to the first padded surface. A pivot frame pivotally attaches to the pilates tower. The pivot frame extends over the second padded surface in one embodiment. In addition, the pivot frame can include a first horizontal bar. The exercise device can also include a second horizontal bar for use as a plie bar.

17 Claims, 18 Drawing Sheets

(56) References Cited

U.S. PATENT DOCUMENTS

| | | | | |
|---|---|---|---|---|
| 2,885,233 | A | 5/1959 | Horowitz | 403/170 |
| 3,062,570 | A | 11/1962 | Schwartz | 403/172 |
| 3,218,661 | A | 11/1965 | Fielder, Jr. | 15/145 |
| 3,501,140 | A | 3/1970 | Eichorn | 272/60 |
| 3,709,487 | A | 1/1973 | Walker | 482/133 |
| 4,136,984 | A | 1/1979 | Hayashi | 403/170 |
| 4,245,838 | A | 1/1981 | Gordon | 482/17 |
| 4,256,300 | A | 3/1981 | Boucher | 472/118 |
| 4,257,590 | A | 3/1981 | Sullivan et al. | 272/117 |
| 4,431,181 | A | 2/1984 | Baswell | 272/62 |
| 4,757,993 | A * | 7/1988 | Rake | 482/130 |
| 4,826,157 | A | 5/1989 | Fitzpatrick | 272/134 |
| 4,844,448 | A | 7/1989 | Niznik | 482/40 |
| 5,013,035 | A | 5/1991 | Nathaniel | 482/129 |
| 5,186,696 | A * | 2/1993 | Pfefferle et al. | 482/40 |
| 5,320,591 | A | 6/1994 | Harmon | |
| 5,561,874 | A | 10/1996 | Malofsky et al. | 5/99.1 |
| 5,626,546 | A | 5/1997 | Little | 482/129 |
| 5,810,702 | A | 9/1998 | Wilkinson | 482/142 |
| 6,110,083 | A | 8/2000 | Riser | 482/142 |
| 6,669,609 | B2 | 12/2003 | Gerschefske et al. | 482/123 |
| 6,805,409 | B2 | 10/2004 | Parker | |
| 6,971,975 | B2 | 12/2005 | Croft | 482/121 |
| 7,101,326 | B2 | 9/2006 | Gerschefske et al. | 482/129 |
| 7,104,937 | B2 | 9/2006 | Arbuckle et al. | 482/142 |
| 7,115,074 | B2 * | 10/2006 | Wu | 482/51 |
| 7,125,369 | B2 | 10/2006 | Endelman | 482/142 |
| 7,137,937 | B2 | 11/2006 | Croft | 482/142 |
| 7,662,076 | B1 * | 2/2010 | Ho | 482/130 |
| 7,878,954 | B2 * | 2/2011 | McBride et al. | 482/123 |
| 8,192,338 | B2 * | 6/2012 | Solow et al. | 482/142 |
| 2001/0018387 | A1 | 8/2001 | Webber | 482/142 |
| 2001/0056011 | A1 | 12/2001 | Endelman | |
| 2003/0186793 | A1 | 10/2003 | Chen | 482/140 |
| 2005/0059536 | A1 | 3/2005 | Croft | 482/123 |
| 2005/0164856 | A1 | 7/2005 | Parmater et al. | 482/142 |
| 2006/0003877 | A1 | 1/2006 | Harmon | 482/142 |
| 2006/0122044 | A1 | 6/2006 | Ho | 482/123 |
| 2006/0160681 | A1 | 7/2006 | McBride et al. | 482/123 |
| 2006/0194680 | A1 | 8/2006 | Croft | 482/123 |
| 2008/0171643 | A1 * | 7/2008 | Baudhuin | 482/148 |
| 2008/0248935 | A1 | 10/2008 | Solow | 482/142 |
| 2009/0054215 | A1 | 2/2009 | McBride et al. | 482/129 |

OTHER PUBLICATIONS

Invitation to Pay Additional Search Fees for PCT International Application No. PCT/US2006/000814, mailed Jun. 2, 2006.

International Search Report and Written Opinion for PCT International Application No. PCT/US2006/000814, mailed Jul. 25, 2006.

* cited by examiner

PORTABLE WORKOUT APPARATUS HAVING A PIVOTALLY MOUNTED EXERCISE BAR

CROSS-REFERENCE TO RELATED APPLICATIONS

This application is a continuation of U.S. patent application Ser. Nos. 11/907,531, filed Oct. 12, 2007, now U.S. Pat. No. 7,878,954, the entire contents of which is hereby incorporated by reference into the present specification.

FIELD OF THE INVENTION

The present invention relates to the field of exercise equipment, and more in particular to portable exercise devices for use in performing various exercises such as Pilates exercises.

BACKGROUND OF THE INVENTION

The Pilates Method is a physical exercise system that was developed by Joseph Pilates in the early $20^{th}$ century. The system focuses on the core postural muscles that help keep the body balanced and are needed to providing support for the spine. In particular, Pilates exercises teach awareness of breath and alignment of the spine, and strengthen the deep torso muscles. Pilates has become popular not only in the field of fitness, but also in rehabilitation. The performance of various exercises, including Pilates exercises, can be enhanced through the use of exercise equipment.

SUMMARY OF THE INVENTION

An exercise device is disclosed that is useful for performing various exercises including Pilates exercises. In a first embodiment, a portable workout apparatus is disclosed having a vertical frame, a first horizontal bar adjustably attached to the vertical frame so as to be positioned at a selected height on the vertical frame, a pivot frame pivotally attached to the vertical frame, a second horizontal bar attached to the pivot frame and pivotally movable therewith, and padded surface areas operatively connected with the vertical frame and disposed on opposite sides of the vertical frame.

In a second embodiment, a pilates exercise device is disclosed that includes a pilates tower having a pair of vertical support members and a cross member extending between the vertical support members, the pilates tower having first and second sides, a first padded surface extending horizontally from the first side of the pilates tower, the first padded surface pivotally mounted to the pilates tower, and a second padded surface extending horizontally from the second side of the pilates tower.

In a third embodiment, an exercise device is disclosed having a pair of vertical support members and a cross member extending between the vertical support members, a pair of horizontal support members each connected to one of the vertical support members, a fairing joining each horizontal support member to each vertical support member, and padded surface areas operatively connected with the vertical support members and disposed on opposite sides of the vertical support members.

In a fourth embodiment, an exercise device is disclosed having a pair of vertical support members and a cross member extending between the vertical support members, a pair of horizontal support members each connected to one of the vertical support members, a first padded surface area pivotally connected on a first side of the vertical support members and configured to pivot from a horizontal position where it is removably connected to at least one of the horizontal support members to a vertical position where it is removably connected to at least one of the vertical support members, and a second padded surface area connected on a second side of the vertical support members.

In a fifth embodiment, an exercise device is disclosed having a pair of vertical support members and a cross member extending between the vertical support members, a pair of horizontal support members each connected to one of the vertical support members, a fairing joining each horizontal support member to each vertical support member, a pivot frame pivotally attached to the pair of vertical support members, a first padded surface area pivotally connected on a first side of the vertical support members, and a second padded surface area connected on a second side of the vertical support members.

Other objects and features and advantages of the present invention will become apparent from the following detailed description, the accompanying drawings, and the appended claims.

BRIEF DESCRIPTION OF THE DRAWINGS

The novel features that are considered characteristic of the invention are set forth with particularity in the appended claims. The invention itself; however, both as to its structure and operation together with the additional objects and advantages thereof are best understood through the following description of the preferred embodiment of the present invention when read in conjunction with the accompanying drawings, wherein:

DETAILED DESCRIPTION OF SEVERAL EMBODIMENTS

While the invention has been shown and described with reference to a particular embodiment thereof, it will be understood to those skilled in the art, that various changes in form and details may be made therein without departing from the spirit and scope of the invention.

Figure 1:
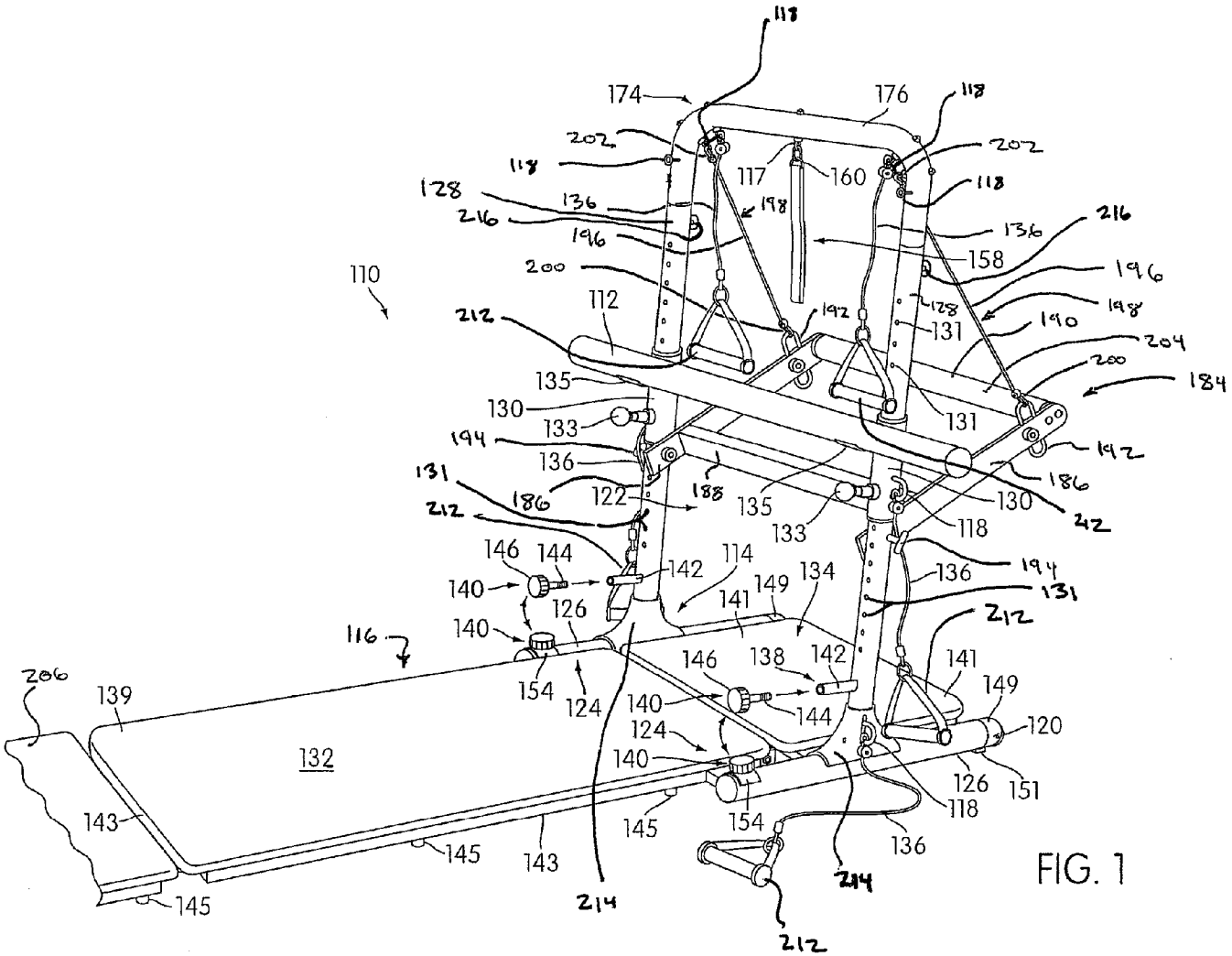
FIG. 1 illustrates a perspective view of an exercise device in a exercise configuration.

FIG. 1 illustrates a perspective view of an exercise device 110 in a exercise configuration. Exercise device 110 or apparatus 110 includes a plie bar 112, also referred to as a horizontal bar, a vertical frame 114, a substantially planar or flat structure having a planar or flat surface 116, a plurality of cord brackets 118, and a plurality of wheels 120. Plie bar 112, vertical frame 114, and structure 116 may form an opening 122. Plie bar 112 is typically made from wood and is used for various lower body stretching exercises, or in combination with various dance exercises, such as ballet movements. While generally made from wood, Plie bar 112, may, in an exemplary embodiment, be made from other substances such as metal, a composite material, or the like, which may then be covered with another substance like a rubber, foam, or plastic coating to enhance the utility of the plie bar 112. Plie bar 112 is typically 2 inches in diameter, thereby providing an ergonomic surface for individuals using plie bar 112 during a workout.

Bar 112 may be provided at an adjustable bar height. This may enable a user to position bar 112 according to various considerations, such as, for example, a height of the user, an exercise to be performed, or other considerations. In a non-limiting example, bar 112 may have a round cross section, and may be 2 inches in diameter. In one embodiment, bar 112 is made of wood. In another embodiment, bar 112 is made of another relatively rigid material. Bar 112 may be covered with a padded material in one embodiment.

Figure 2:
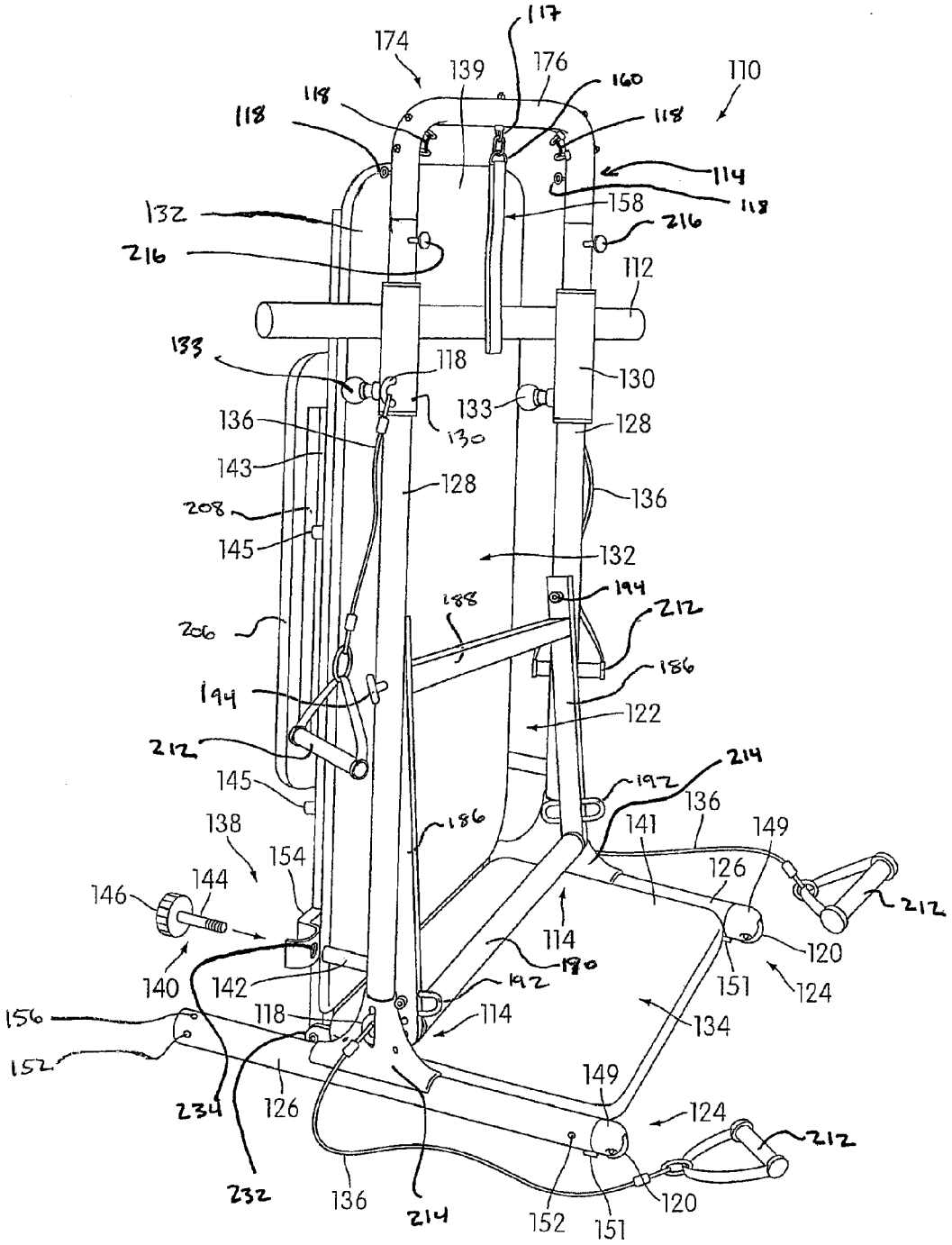
FIG. 2 illustrates a perspective view of an exercise device in a storage configuration.

Frame 114 may include a base 124 that is formed of two base members 126, support members 128, and sliding bar brackets 130. Base 124 may engage the floor and may provide a stable foundation for frame 114. Support members 128 may extend out of base 124 to support bar 112. Sliding bar brackets 130 may be disposed along support members 128 and may hold bar 112. Sliding bar brackets 130 may enable the height of bar 112 to be adjusted by moving sliding bar brackets 130 along support members 128. Base members 126 may also include feet 151 to lift the bottom surface of base members 126 off of the floor. Feet 151 may be formed of a hard or rubberized plastic so as to provide a frictional grip with the floor and to protect the floor from damage by base members 126. Fairings 214 are provided where support members 128 and base members 126 are joined. Fairings 214, in one embodiment, are made of a structural material and provide structural support to members 126 and 128. Alternatively, fairings 214 may placed over the joint of members 126 and 128 for aesthetic non-structural purposes and be made of plastic. Support members 128, also referred to as vertical members 128, are joined together by horizontal member 176. Horizontal member 176 is held in place with respect to vertical members 128 by pins 216. Removal of pins 216 allows for the removal of horizontal member 176 from the rest of the device, thereby allowing the user to perform certain exercises where the user's body is passed through the area formerly occupied by horizontal member 176. As shown in FIG. 2, for example, fairing 214 has an opening through which cord bracket 118 extends.

Planar surface 116 includes a first padded surface 132. First padded surface 132 is pivotally attached to vertical frame 114. Planar surface 116 also include a second padded surface 134. Planar surface 116 also includes a third padded surface 206. Third padded surface 206 is removably attached to first padded surface 132. Third padded surface 206, like first and second padded surfaces 132 and 134, is supported by feet 145 when it is positioned horizontally on the floor. Together, padded surfaces 132 and 134 provide a comfortable surface upon which a user can perform exercises.

In some embodiments, frame 114 may include support member openings 131 formed in support member 128. Sliding bar bracket 130 may be secured from sliding along support member 128 by a bracket pin 133. Bracket pin 133 may engage one of support member openings 131 to secure sliding bar bracket 130 with respect to support member 128. By engaging bracket pin 133 with a selected support member opening, a user may selectably configure the height at which bar 112 will be supported by frame 114. In one embodiment, bracket pin 133 includes a substantially spherical knob that the user can grasp while inserting bracket pin 133 into, or removing bracket pin 133 from, one of support member openings 131.

According to various embodiments, sliding bar bracket 130 may include a bar holding member 135 that holds bar 112. Bar 112 may be secured to bar holding member 135 via one or more fasteners, such as, for example bolts 137.

In some embodiments of the invention, structure 116 may be positioned between support members 128, and may be operatively coupled to frame 114. Structure 116 may include a first surface portion 132 and a second surface portion 134. As is illustrated in FIG. 2, first surface portion 132 may pivot, independent of second surface portion 134, to a substantially vertical position for storage and transport. In some embodiments, first surface portion 132 may extend out from under bar 112 in a first direction and second surface portion 134 may extend out from under bar 112 in a second direction. First surface portion 132 may extend out further than second surface portion 134. When using apparatus 110, the user may stand, sit, lie, or otherwise be positioned on structure 116. This may provide ballast to apparatus 110 during an exercise. In other words, the force applied to structure 116 by the user's weight may enhance the stability of apparatus 110 when the exercise being performed by the user applies a load to apparatus 110.

According to various embodiments of the invention, first surface portion 132 and second surface portion 134 may include first padded member 139 and second padded member 141, respectively. First padded member 139 and second padded member 141 may provide structure 116.

First padded member 139 and/or second padded member 141 may be substantially flat, or structure 116 may be contoured. For example, first padded member 139 and/or second padded member 141 may be contoured and/or padded to enhance the comfort of the user. Second padded member 141 may be supported by base members 126 (see, e.g., FIG. 3).

In some embodiments of the invention, first surface portion 132 discussed in paragraph 34 may include a first surface portion frame 143 and first surface portion supports 145. First surface portion frame 143 may support first padded member 139. First surface portion feet 145 may be fixed to first surface portion frame 143, and may engage the floor. First surface portion feet 145 may be constructed to provide stability to apparatus 110 via friction between engaged surfaces of first surface portion feet 145 and the floor. For example, first surface portion feet 145 may be constructed at least in part of a rubberized material, or another material selected to enhance friction between surface portion feet 145 and the floor.

According to various embodiments of the invention, opening 122, formed by bar 112, frame 114, and surface 116, may be large enough to accommodate the user within opening 122. In some instances, opening 122 may enable the user to pass back and forth under bar 112. An opening 122 of this size may enable various exercises in which the user may be positioned under bar 112 to be performed on apparatus 110. This may enhance the amount and/or types of exercises that may be performed by the user on apparatus 110.

According to one embodiment of the invention, device 110 includes a pivot frame 184. Pivot frame is formed of beams 186 that are laterally supported by cross piece 188 and bar 190. At the ends of beams 186 are loops 192 that are fixed to beams 186. Loops 192 are provided for attaching various cables to pivot frame 184. Pivot frame 184 is pivotally mounted to vertical frame 114 by pins 194. Pins 194 have plastic ergonomic ends extending from the outer sides of frame 114. Pins 194, in a preferred embodiment, have threaded ends which engage nuts on the interior side of frame 114, thereby holding pins 194 in position with respect to frame 114. A spring cable 196 attaches to pivot frame 184 at loop 192 and to frame 114 at connection 118. Spring cable 196 functions to hold pivot frame 184 at an angled position with respect to frame 114. Spring cable 196 is sheathed with a protective covering 198. Spring cable 196 attaches to loops 192 and hook 118 with connectors 200 and 202 respectively. Bar 190 is covered with a spongy rubberized coating 204 to provide an ergonomic surface for users of bar 190.

Device 110 is configured to function as an exercise apparatus. Vertical fame 114, including horizontal bar 112 and pivot frame 184 with bar 190 is configured to function as a Pilates tower allowing users to perform various Pilates exercises while on padded surfaces 132 and 134. For instance, users can perform various stretching exercises by placing one of their legs on bar 112 when standing on surface 132. Alternatively, users can lay on surfaces 132 and 134 and reach up and grab bar 112 or bar 190 to perform various pull-up exercises where some of the user's body weight is supported by surfaces 132 and 134.

By having two surfaces, 132 and 134 on either side of vertical frame 114, multiple users can exercise with device 110 by standing on opposite sides of vertical frame 114 on either surface 132 or 134. Further, with surface 132 pivotally mounted to vertical frame 114, the size of device 110 can be greatly reduced making the device easier to store.

Pivot frame 184 is placed on frame 114 the side opposite to horizontal bar 112. By placing pivot frame 184 on the side opposite of horizontal bar 112, multiple users can exercise with bar 112 and pivot frame 184 at the same time by standing on opposite sides of frame 114, thereby enhancing the utility of exercise device 110.

While pivot frame 184 is shown extending from frame 114 on the side opposite to horizontal bar 112, it is possible to position pivot frame 184 to extend from the same direction as horizontal bar 112. Pivot frame 184 can be detached from cable 196 and pivoted to extend from the other side of frame 114. Once it is extended from the other side of frame 114, cable 196 can be reconnected to one of loops 192. As loops 192 are provided on both sides of beams 186, it is possible to connect cable 196 to pivot frame 184 on either side of frame 114 in an identical manner.

Cables 136 may be elastic. When cables 136 are elastic, the can provide a user with the ability to perform any type of pulling exercise, such as bicep curl exercises, back exercises, and shoulder exercises. Cables 136 may also be inelastic, in which case they can function as devices to enable a user to perform various stretching exercises which require a fixed point that a user can pull or push against. Cables 136 are coupled to handles 212. Handles 212 are typically made of a flexible and durable material that includes a rigid or semi-rigid handle bar attached with a flexible strap to cable 136.

In one embodiment, wheels 120 may enhance the portability of apparatus 110. Wheels 120 may be provided on frame 114. For example, wheels 120 may be provided on base 124. More particularly, wheels 120 may be disposed on base members 126 at the ends of base members 126 that are adjacent to second surface portion 134.

Apparatus 110 may include one or more lock or locking mechanisms 138. Locking mechanisms 138 may secure first surface portion 132 in a substantially vertical position for storage (shown in FIGS. 2-4) and/or secure first surface portion 132 in a substantially horizontal position for use (shown in FIG. 1). In a non-limiting example, locking mechanisms 138 may include a threaded fastener 140, a knob engaging member 154 provided on first surface portion 132, a threaded frame opening 156 formed in frame 114, and a receiving tube 142 provided on frame 114. Threaded fastener 140 may include a threaded portion 144 and a knob portion 146. Receiving tube 142 may include a threaded opening.

Figure 3:
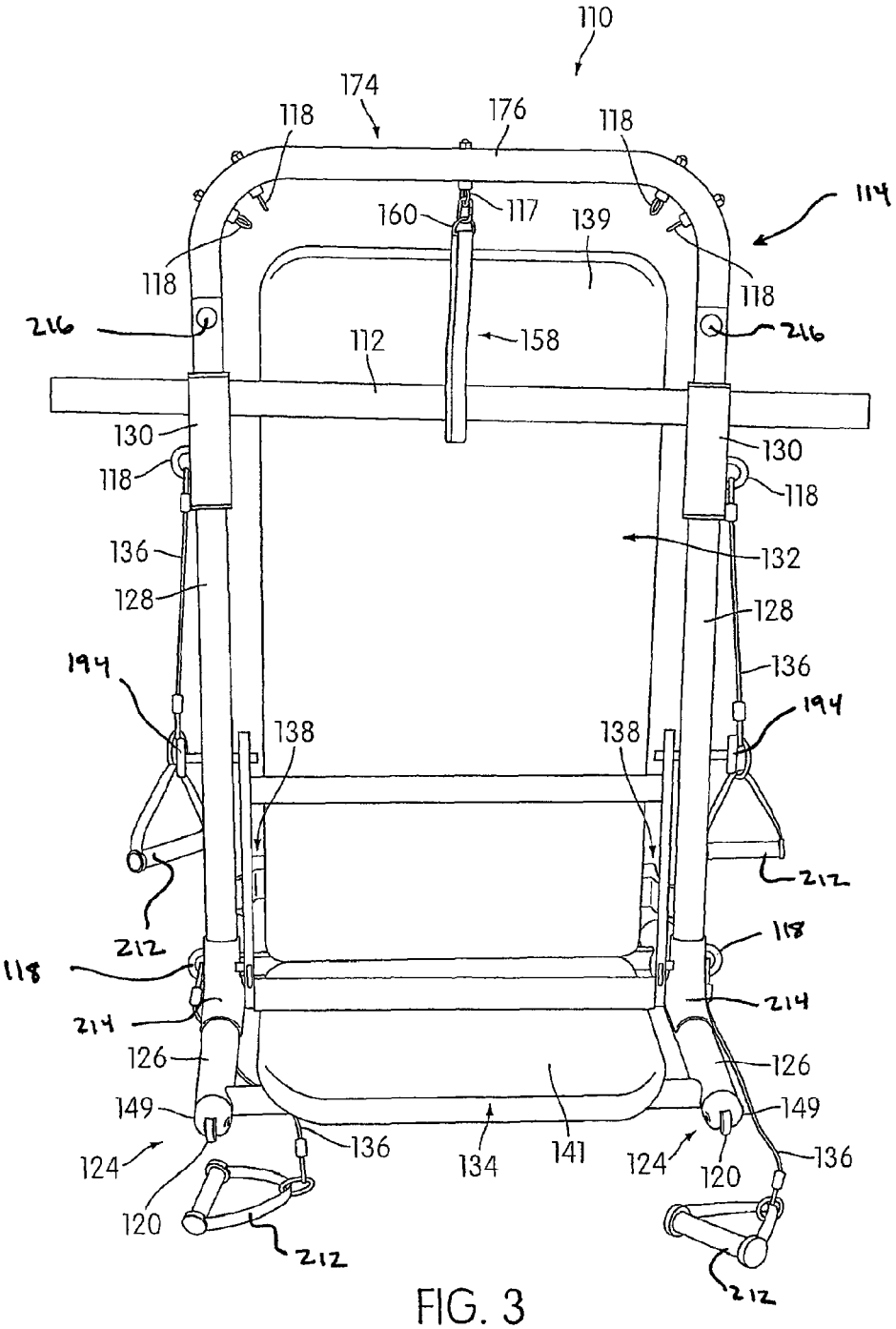
FIG. 3 illustrates a rear view of an exercise device in a storage configuration.

Surface 132 can pivot from the horizontal position shown in FIG. 1 to a vertical position shown in FIGS. 2 and 3. When placed in the horizontal position, surface 132 provides an ergonomic a platform upon which a user can exercise. Surface 132, when in the horizontal position, also provides stability to device 110, thereby enabling the use of device 110 for exercise purposes.

In one embodiment, resistance cord 136 is releasably coupled with a strap 158 at an end of resistance cord 136 opposite the releasable attachment to cord bracket 118. Strap 158 includes a member 160 that can be engaged with resistance cord 136 to releasably couple resistance cord 136 to strap 158. Member 160 is coupled to a hook 117 attached to member 176.

FIG. 2 illustrates a perspective view of an exercise device 110 in a storage configuration. Surface 132 is pivotally mounted to frame 114. Surface 132 may be pivoted around pivot point 232 from a horizontal configuration, as shown in FIG. 1, to a vertical position shown in FIG. 2. The horizontal area occupied by device 110 is greatly reduced by pivoting surface 132 from the horizontal to the vertical position. Surface 132 is held in a vertical position by locking mechanisms 138. Locking mechanisms 138 may include a threaded fastener 140, a knob engaging member 154 provided on first surface portion 132, a frame threaded frame opening 156 formed in frame 114, and a receiving tube 142 provided on frame 114. Threaded fastener 140 may include a threaded portion 144 and a knob portion 146. Receiving tube 142 may include a threaded opening. FIG. 2 also illustrates an exemplary embodiment where four cables 136 are connected at four different locations 118 to facilitate exercises by a user. Knob engaging member 154 includes a hole 234 for receiving knob 146 (also shown in FIGS. 13 and 14).

Third padded surface 206 is shown attached to the rear portion of first padded surface 132. To pivot first padded surface 132 from the horizontal to the vertical configuration, third padded surface 206 is first detached from first padded surface 132. Once third padded surface 206 is detached, first padded surface 132 is pivoted into the vertical configuration. Then, once first padded surface 132 is pivoted into the vertical configuration, third padded surface 206 is hung off the back of first padded surface 132 for storage.

FIG. 3 illustrates a rear view of exercise device 110 in a storage configuration. In this non-limiting example, device 110 includes a pair of locking devices 138 that attach each side of surface 132 to frame 114. In another embodiment, device 110 may have a single locking device 138 to secure surface 132 to frame 114. Note that device 110 is provided with a pair of wheels 120 on each member 126. One exemplary way of transporting device 110 is by pulling back on bar 112 such that device 110 is pivoted onto wheels 120, and thus can be easily rolled around to a storage location. Minimizing the amount of floor space occupied by device 110 when in a storage configuration enhances the utility of device 110. Exercise clubs can hold various exercise/Pilates classes using a plurality of devices 110 and be able to store them in a vastly smaller space due to the ability of device 110 to transform into the storage configuration shown in FIGS. 2 and 3. Also, various users may wish to use device 110 for home exercise. The storage configuration of device 110 thus enables the user to have device 110 for exercise at home and still be able to store it in a much smaller configuration.

Figure 4:
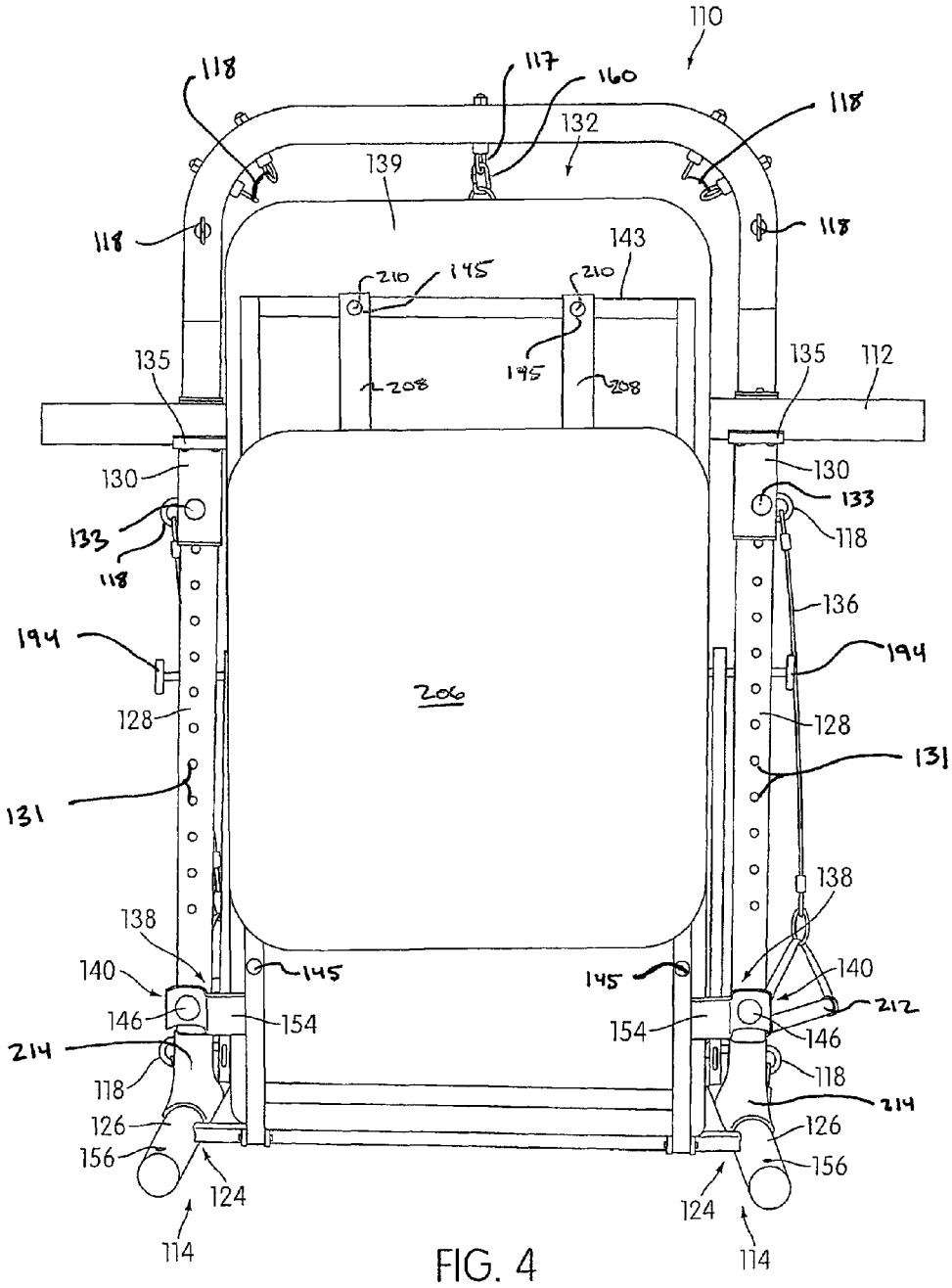
FIG. 4 illustrates a front view of an exercise device in a storage configuration.

FIG. 4 illustrates a front view of an exercise device in a storage configuration. Locking mechanisms 138 may include a threaded fastener 140, a knob engaging member 154 provided on first surface portion 132, a frame threaded frame opening 156 formed in frame 114, and a receiving tube 142 provided on frame 114. Threaded fastener 140 may include a threaded portion 144 and a knob portion 146. Receiving tube 142 may include a threaded opening. In this non-limiting example, device 110 includes a pair of locking devices 138 that attach each side of surface 132 to frame 114. In another embodiment, device 110 may have a single locking device 138 to secure surface 132 to frame 114. Note that in this example, frame 143 includes open portions in order to provide structural rigidity and support to surface 132 while minimizing weight, thereby making it easier for a user to manually pick-up and pivot frame 143 between horizontal and vertical positions. FIG. 4 also provides a view of the plurality of feet 145 that support frame 143 on a floor when surface 132 is in the horizontal configuration.

Third padded surface 206 is supported by frame members 208. In a preferred embodiment, frame members 208 pivotally mount to frame 143. Frame members 208 are each provided with a hole 210 that receives feet 145 mounted on first padded surface 132. When first padded surface 132 is pivoted into a vertical position, feet 145 mounted on first padded surface 132 extend outward horizontally. Feet 145 provide the structure upon which third padded surface 206 is hung from for storage.

Figure 5:
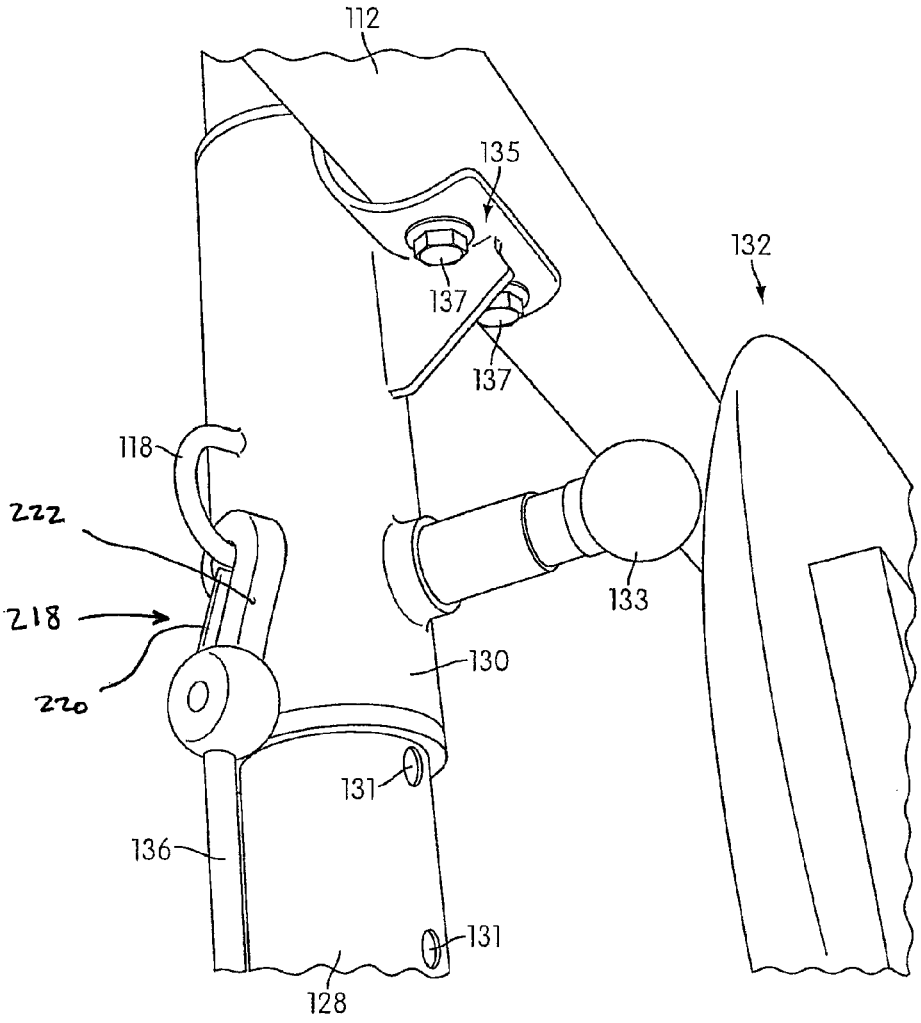
FIG. 5 illustrates a perspective view of an adjustable horizontal bar attached to a vertical frame.

FIG. 5 illustrates a perspective view of adjustable horizontal bar 112 attached to vertical frame 114. Note that surface 132 is raised into the vertical storage position in this figure. Bar 112 is attached to frame 114 in a manner such that it can move vertically and be engaged to frame 114 to hold it in a fixed position. Bar 112 is attached to bar bracket 130, which is a hollow tube that slides over tubular support members 128. bracket pin 133 can extend through bar bracket 130 into holes 131, thereby holding bar 112 in a fixed position with respect to vertical frame 114. By pulling pins 133 away from frame 114, pins 133 are disengaged from holes 131, thereby allowing bar 112 to be moved vertically with respect to frame 114. Once bar 112 has been placed into a desired position, pins 133 are reinserted into the corresponding holes 131 to hold bar 112 in a fixed position.

Figure 6:
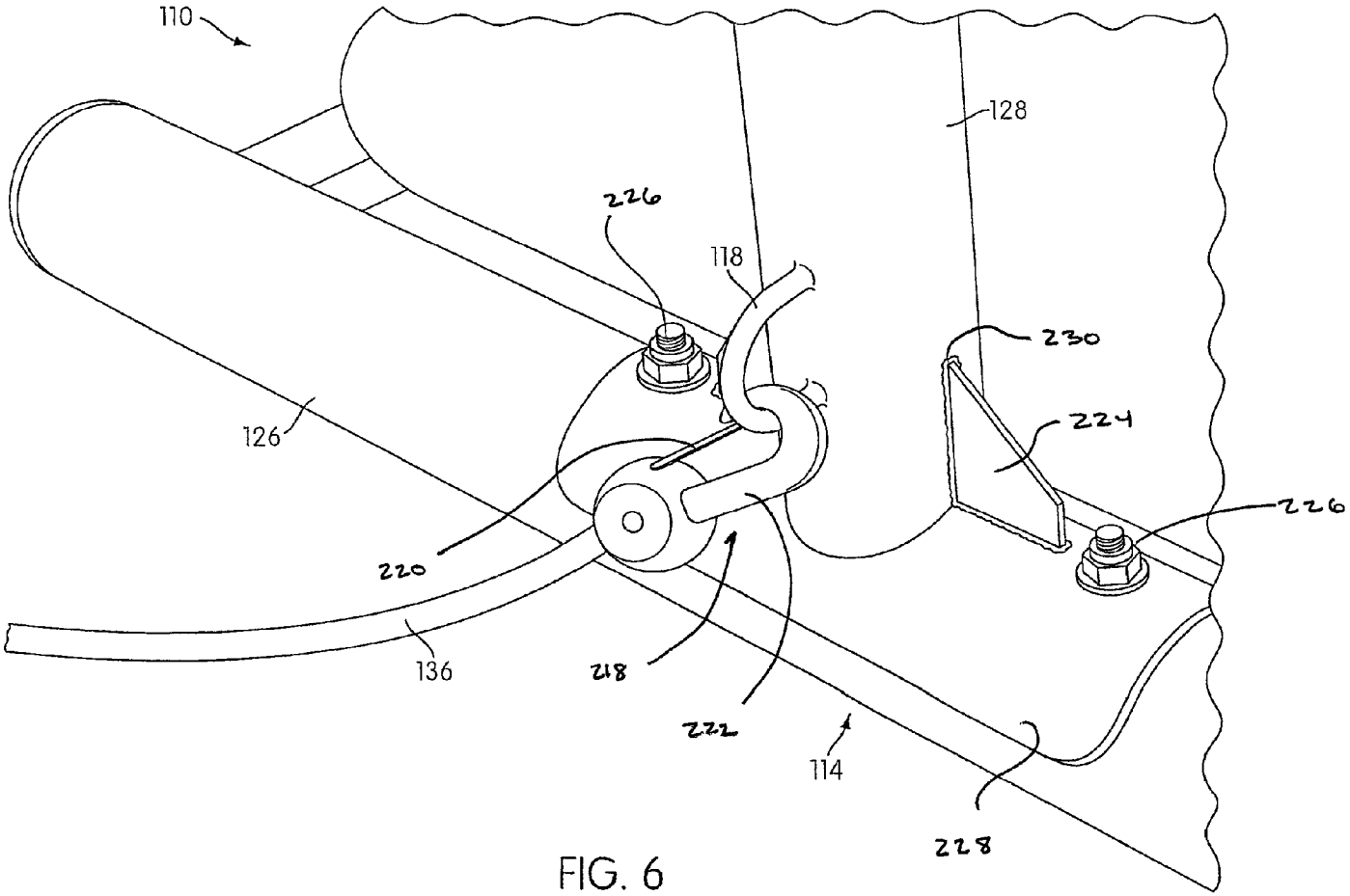
FIG. 6 illustrates a perspective view of a base of a vertical frame.

FIG. 6 illustrates a perspective view of base 126 of vertical frame 114. Frame 114 includes a base 124 that is formed of two base members 126 and support members 128. Base 124 may engage the floor and may provide a stable foundation for frame 114. Support members 128 may extend out of base 124 to support bar 112. In this exemplary embodiment, support members 128 are bolted to base members 126. Support member 128 is provided with connection 118 to connect to cable 136. Connection 118 at the base of frame 114 enables a user to perform various exercises requiring them to pull up on a cable such as with bicep curl or shoulder exercises. Support member 128 is attached to base member 126. Support member 128 is welded to plate 228. Reinforcing ribs 224 are welded between support members 128 and plate 228 with welds 230. Plate 228 is then bolted to base member 126 with bolt, washer, and nut assemblies 226.

Cables 136 are attached to the connections 118 with clips 218 that include a rigid member 222 and a spring-loaded moveable member 220 that allows clip 218 to engage connection 118 and close to keep clip 218 attached.

Figure 7:
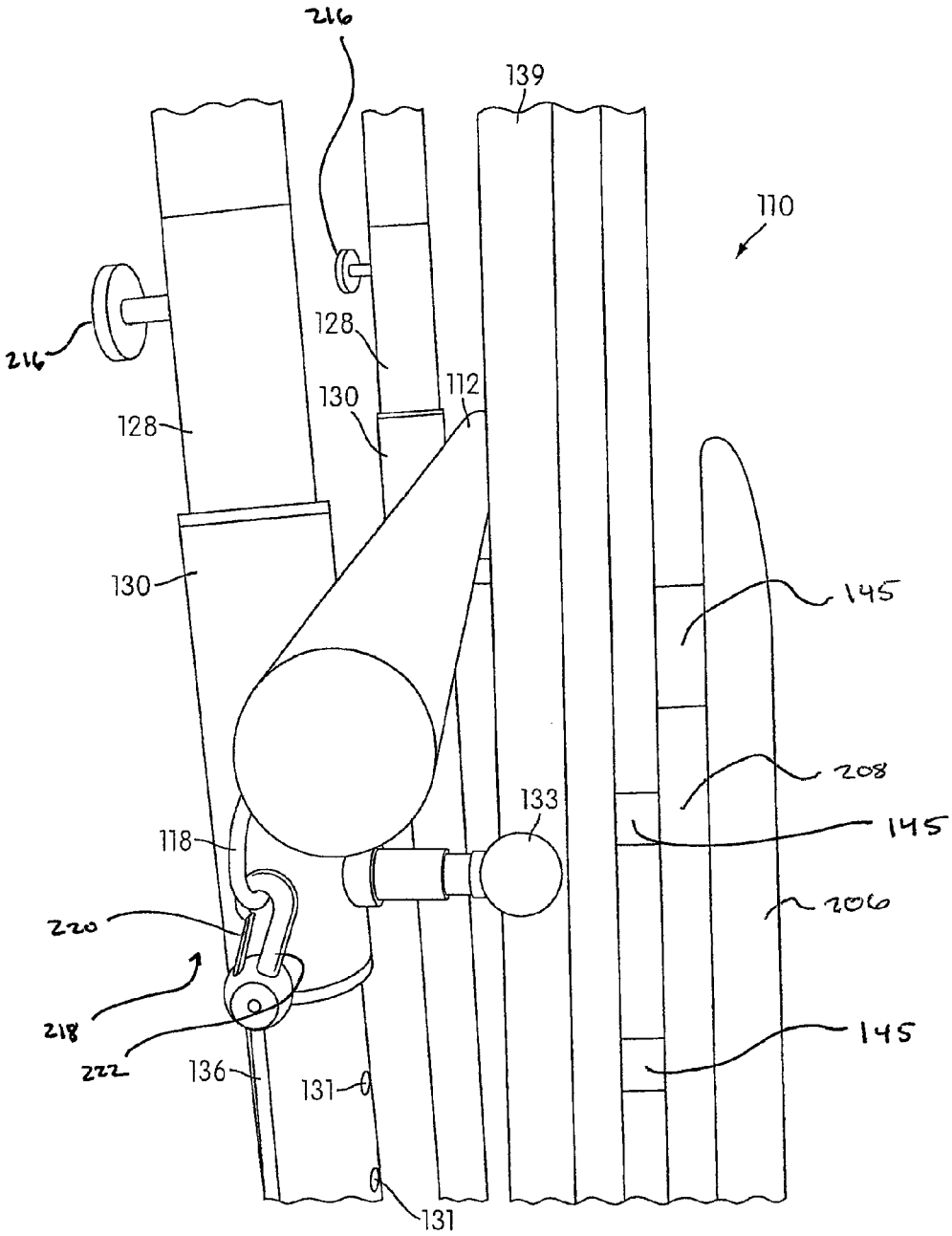
FIG. 7 illustrates a side view of a top portion of a vertical frame when the exercise device is in a storage configuration.

FIG. 7 illustrates a side view of a top portion of a vertical frame when the exercise device is in a storage configuration. In some embodiments, cord brackets 118 may be adapted for attaching an end of a resistance cord 136. The user may use resistance cords 136 to perform motions with resistance. Each resistance cord 136 may include a member that is resiliently elongated (e.g., a bungee cord). Cord brackets 118 may be configured such that resistance cords 136 may be selectively attached and detached to enable the user to select a level of resistance to be provided. For instance, cord brackets 118 may include a loop, a hook, or another mechanism for enabling selective attaching and detaching of resistance cords 136. Cord brackets 118 may be located on bar 112, frame 114, and/or surface 116. Cord brackets 118 may be fixed.

Figure 8:
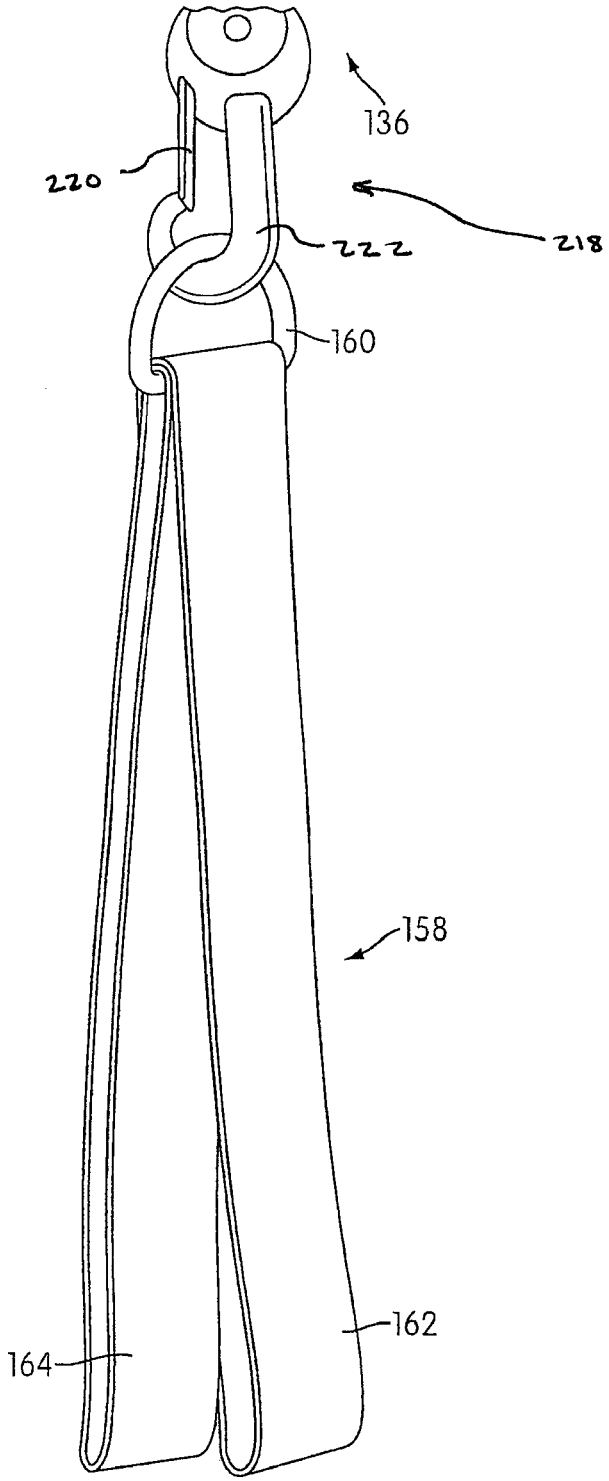
FIG. 8 illustrates a double exercise strap.

FIG. 8 illustrates a double exercise strap. In one embodiment, resistance cord 136 is releasably coupled with a strap 158 at an end of resistance cord 136 opposite the releasable attachment to cord bracket 118. Strap 158 includes a member 160 that can be engaged with resistance cord 136 to releasably couple resistance cord 136 to strap 158. Outer loop 162 and inner loop 164 are formed from a pliable material, and are connected to member 160. In one embodiment, outer loop 162 and inner loop 164 are formed from a woven material.

Figure 9:
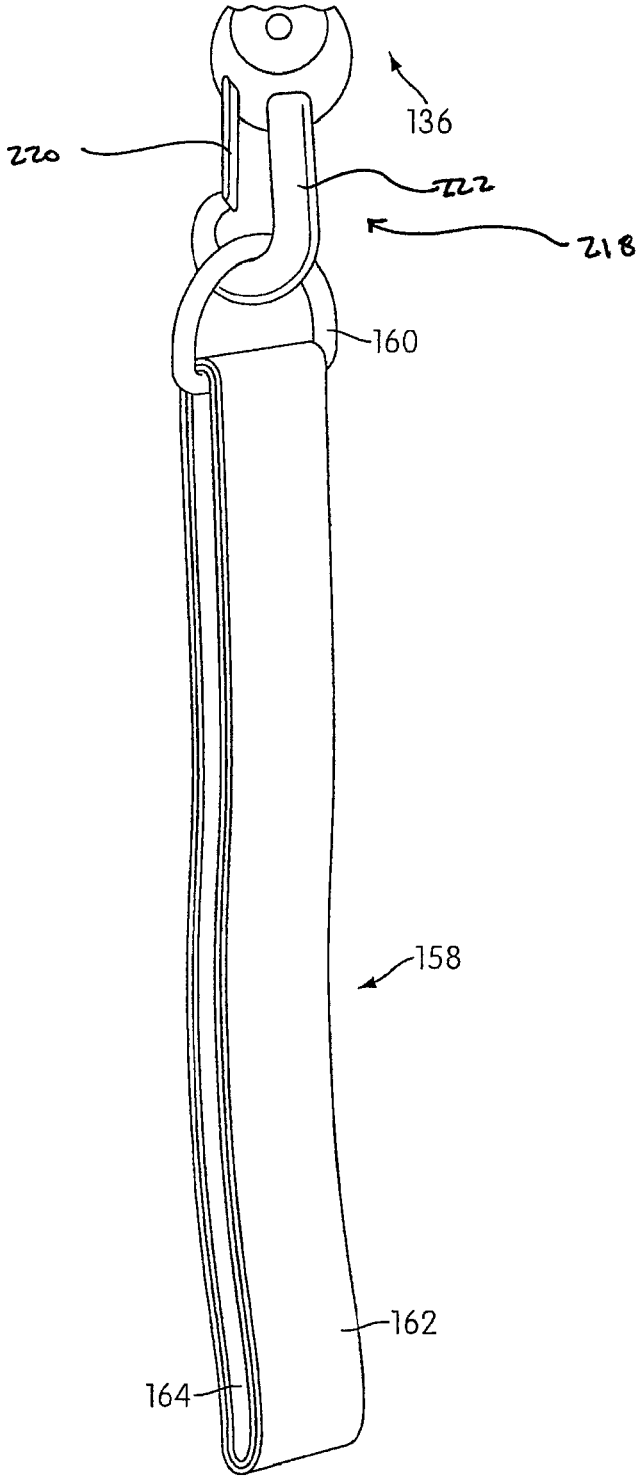
FIG. 9 illustrates a single exercise strap.

FIG. 9 illustrates a single exercise strap. Strap 158 has an inner loop 164 that is positioned within outer loop 162. In one embodiment, loops 162 and 164 are provided to be placed about an appendage of a user (e.g., a leg, an arm, etc.). In such an embodiment, each of loops 162 and 164 may be placed about the same appendage or separate appendages (e.g., about each leg).

Figure 10:
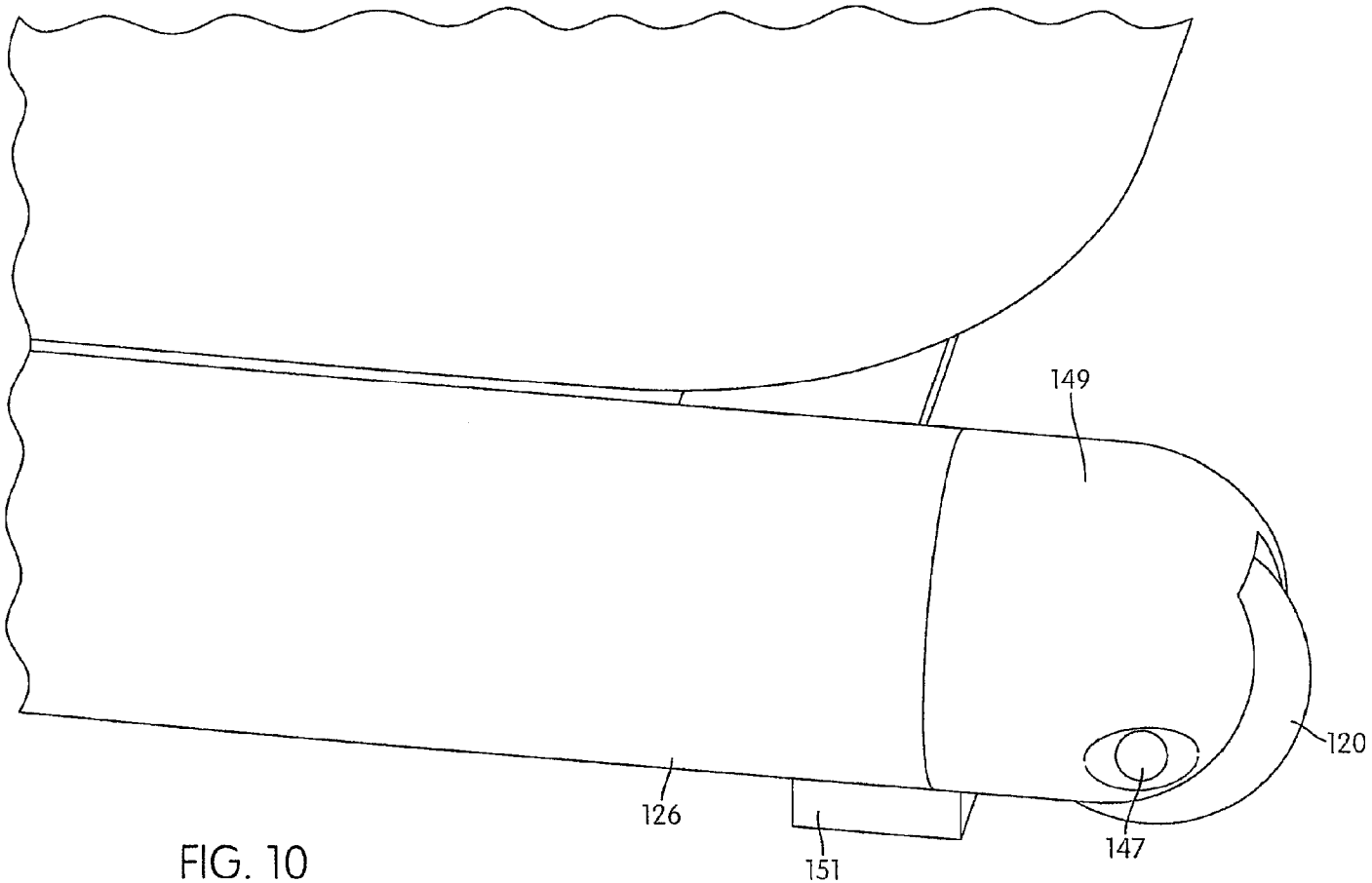
FIG. 10 illustrates a wheel mounted to a vertical frame.

FIG. 10 illustrates a wheel 120 mounted to vertical frame 114. In this exemplary embodiment, wheel 120 is attached to base member 126 with an axle 147 about which wheel 120 rotates. A hood 149 covers a portion of wheel 120 such that wheel 120 is substantially hidden from a user that is using apparatus 110. By covering wheel 120 in this manner, hood 149 may protect the user from inadvertently stepping on wheel 120 and/or inadvertently placing his/her hand on wheel 120.

Figure 11:
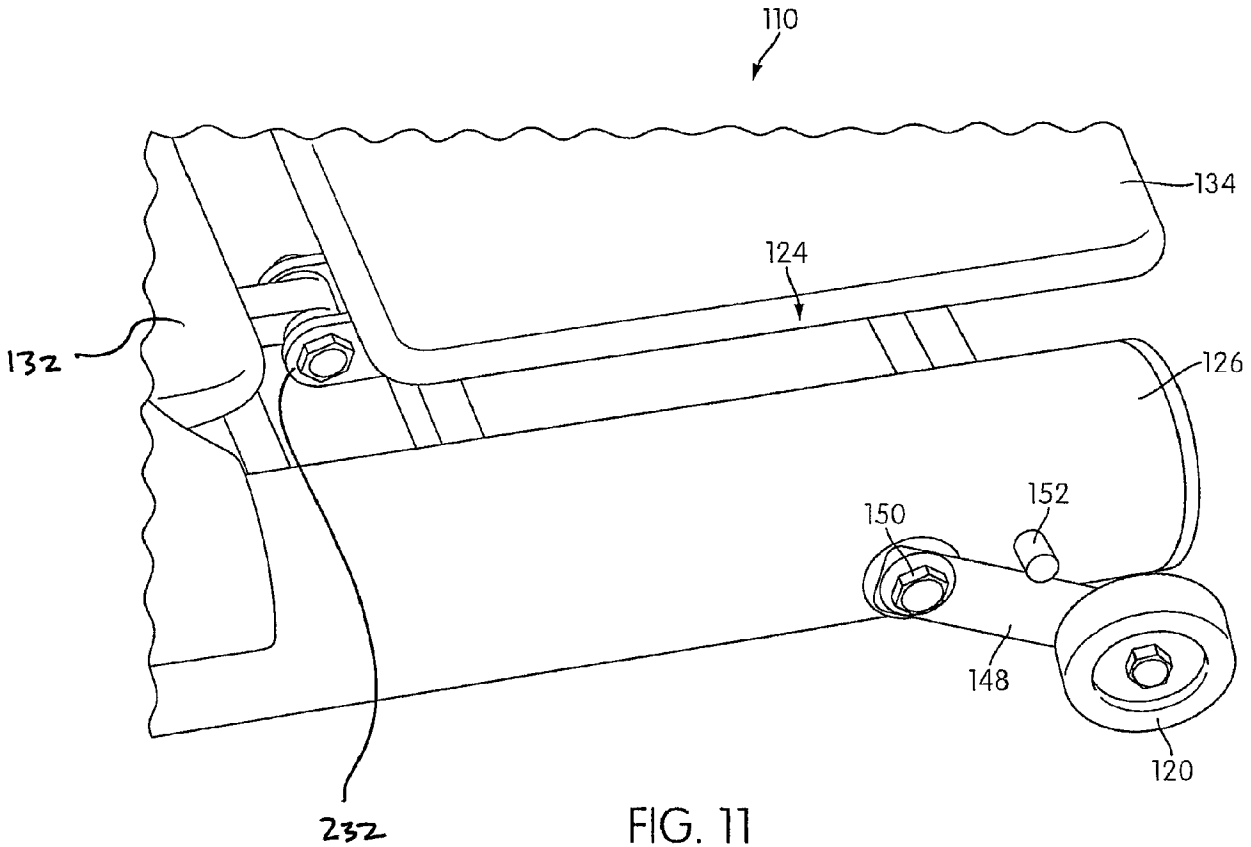
FIG. 11 illustrates a wheel pivotally mounted to a vertical frame in a first position.

FIG. 11 illustrates a wheel 120 pivotally mounted to vertical frame 114 in a first position. Wheel 120 may be secured to a rotatable member 148 that may be secured to frame 114 at an axis of rotation 150. When rotatable member 148 is rotated about axis 150 to bring wheel 120 into the engaged position, a stop 152 may engage rotatable member 148. This may hold wheel 120 in the engaged position while wheel 120 bears some or all of the weight of apparatus 110.

Figure 12:
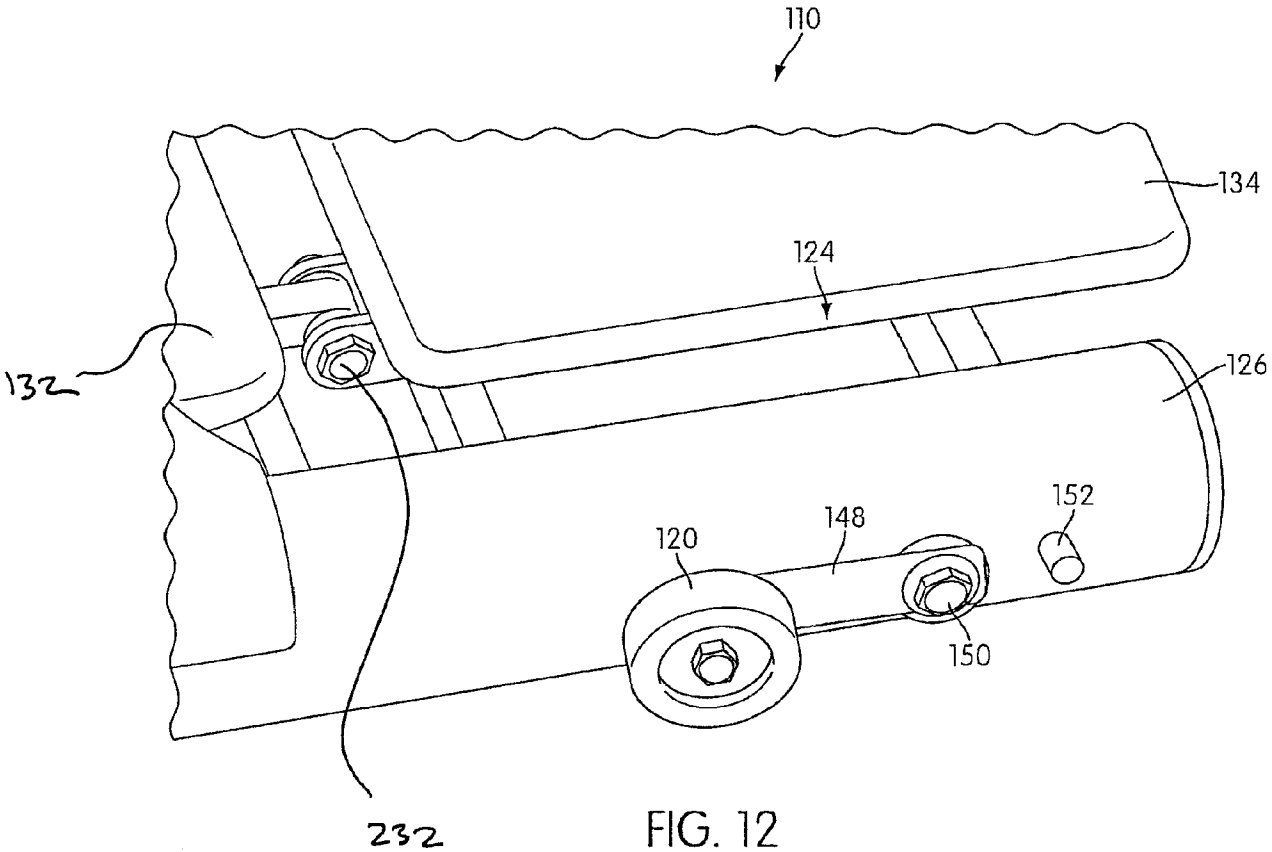
FIG. 12 illustrates a wheel pivotally mounted to a vertical frame in a second position.

FIG. 12 illustrates a wheel 120 pivotally mounted to 114 vertical frame in a second position. To bring wheel 120 into the unengaged position, rotatable member 148 may be rotated about axis 150 away from stop 152. In the unengaged position, the weight of apparatus 110 may not be born by wheel 120 because the weight of apparatus 110 causes rotatable member 148, which is not stopped in the unengaged position, to rotate about axis 150 until frame 114 engages the floor and bears the weight of apparatus 110.

Figure 13:
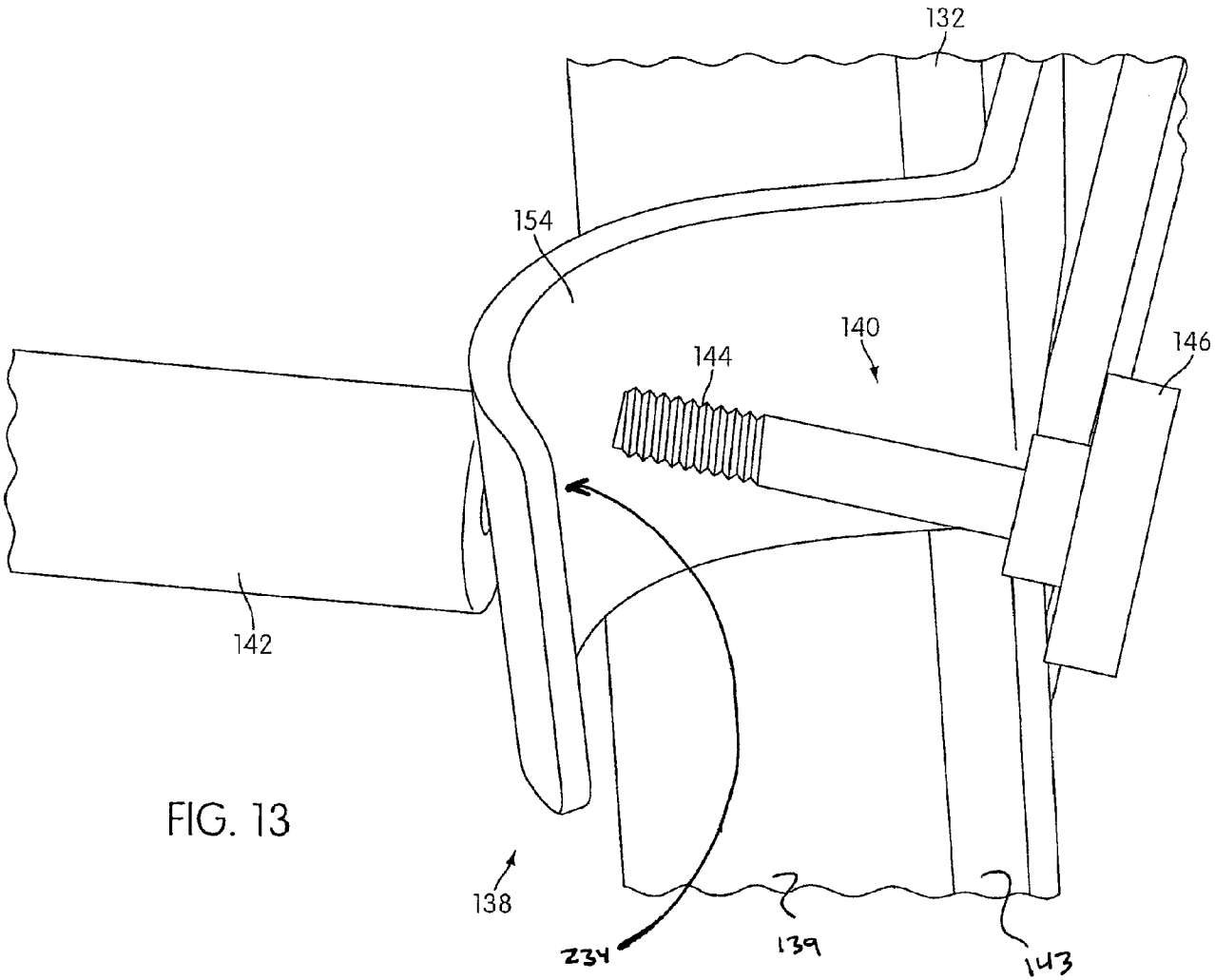
FIG. 13 illustrates a structure for attaching a first padded surface to a vertical frame.

FIG. 13 illustrates a structure for attaching a first padded surface 132 to vertical frame 114. Locking mechanism 138 secures first surface portion 132 in a substantially vertical position (illustrated also, e.g., in FIG. 2). When first surface portion 132 is pivoted into a substantially vertical position, threaded portion 144 of threaded fastener 140 may be introduced into the threaded opening of receiving tube 142. This may cause knob portion 146 of threaded fastener 140 to engage knob engaging member 154 of first surface portion 132, thereby securing first surface portion 132 in the substantially vertical position.

Figure 14:
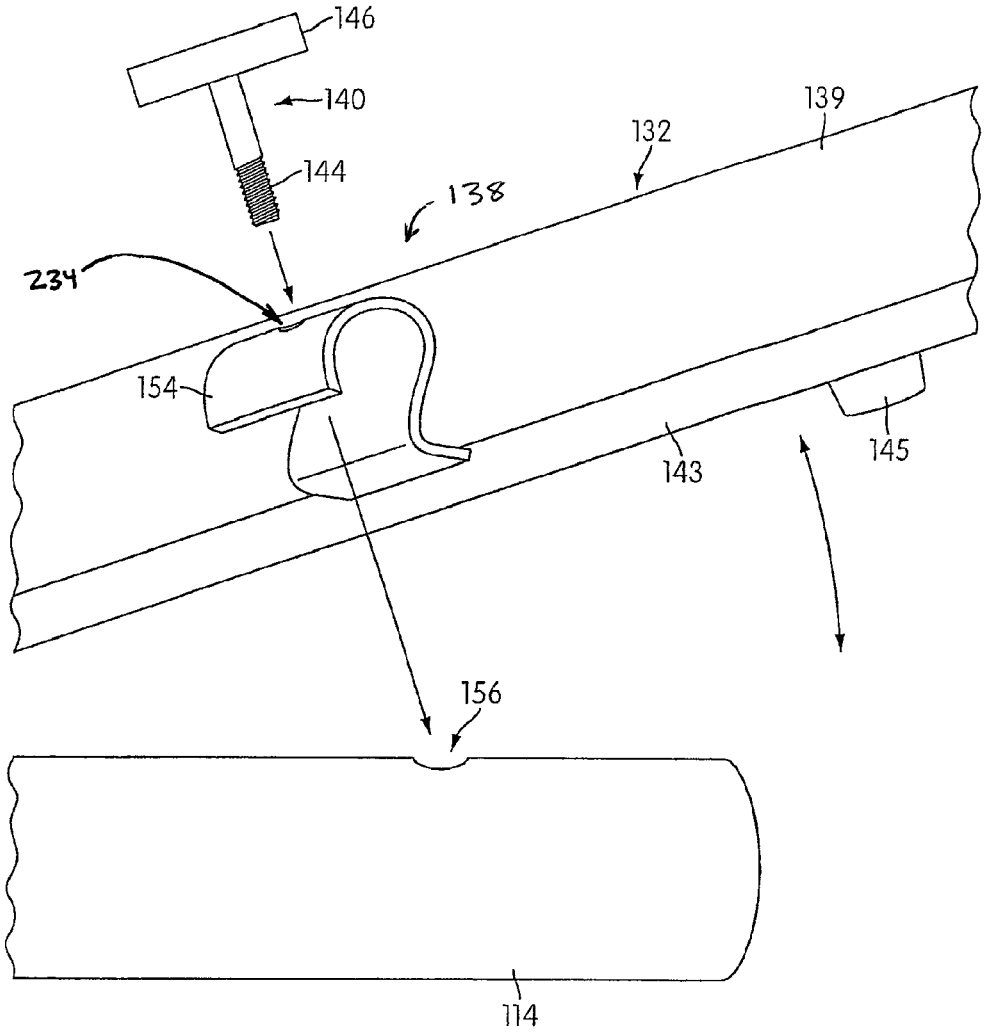
FIG. 14 illustrates a structure for attaching a first padded surface to a horizontal frame.

FIG. 14 illustrates a structure for attaching first padded surface 132 to frame 114. Locking mechanism 138 secures first surface portion 132 in a substantially horizontal position (illustrated also, e.g., in FIG. 1). As first surface portion 132 is pivoted into a substantially horizontal position, threaded portion 144 of threaded fastener 140 may be provided, via knob engaging member 154 to threaded frame opening 156. The knob portion 146 of threaded fastener 140 may engage knob engaging member 154, securing knob engaging member proximate to frame 114, thereby securing first surface portion 132 in a substantially horizontal position. Fixing first surface portion 132 to frame 114 for use may enhance the stability of apparatus 110, by increasing the effective footprint of frame 114, enabling the body weight of the user to provide ballast directly (or substantially directly) to frame 114, or may otherwise enhance the stability of apparatus 110.

Figure 15:
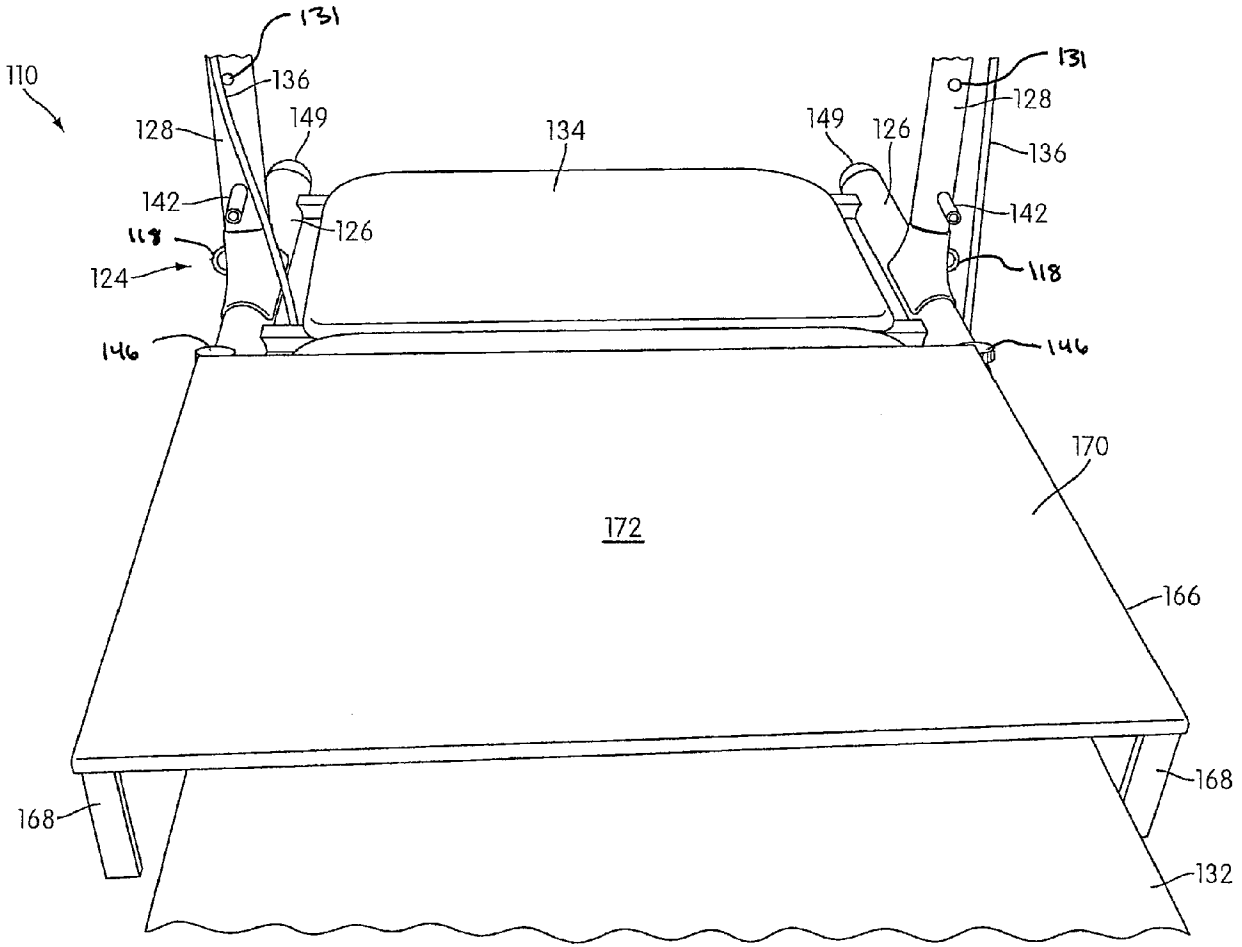
FIG. 15 illustrates a perspective view of a first and second padded surface.

FIG. 15 illustrates a perspective view of a first and second padded surfaces 132 and 134 attached to vertical frame 114. A rigid platform 166 may be used in combination with apparatus 110. Platform 166 includes supports 168 that support a planar member 170 just above first surface portion 132. Planar member 170 provides a substantially planar surface 172 that is rigid. Planar member 170 is formed with dimensions such that supports 168 engage the floor on each side of first surface portion 132. In one embodiment, planar member 170 is formed from wood. In other embodiments, planar member 170 may be formed from other rigid materials. By placing platform 166 over first surface portion 132, a user is able to have a rigid surface on which to stand, kneel, lie, etc. while exercising, rather than the padded surface provided by first surface portion 132. Platform 166 can selectively be provided in place above first surface portion 132 at virtually any location along first surface portion 132 at which the user intends to exercise (e.g., stand, kneel, lie, etc.). Platform 166 can also be provided on the other side of opening 122, above second surface portion 134, should the user desire a rigid surface on that side of opening 122.

Figure 16:
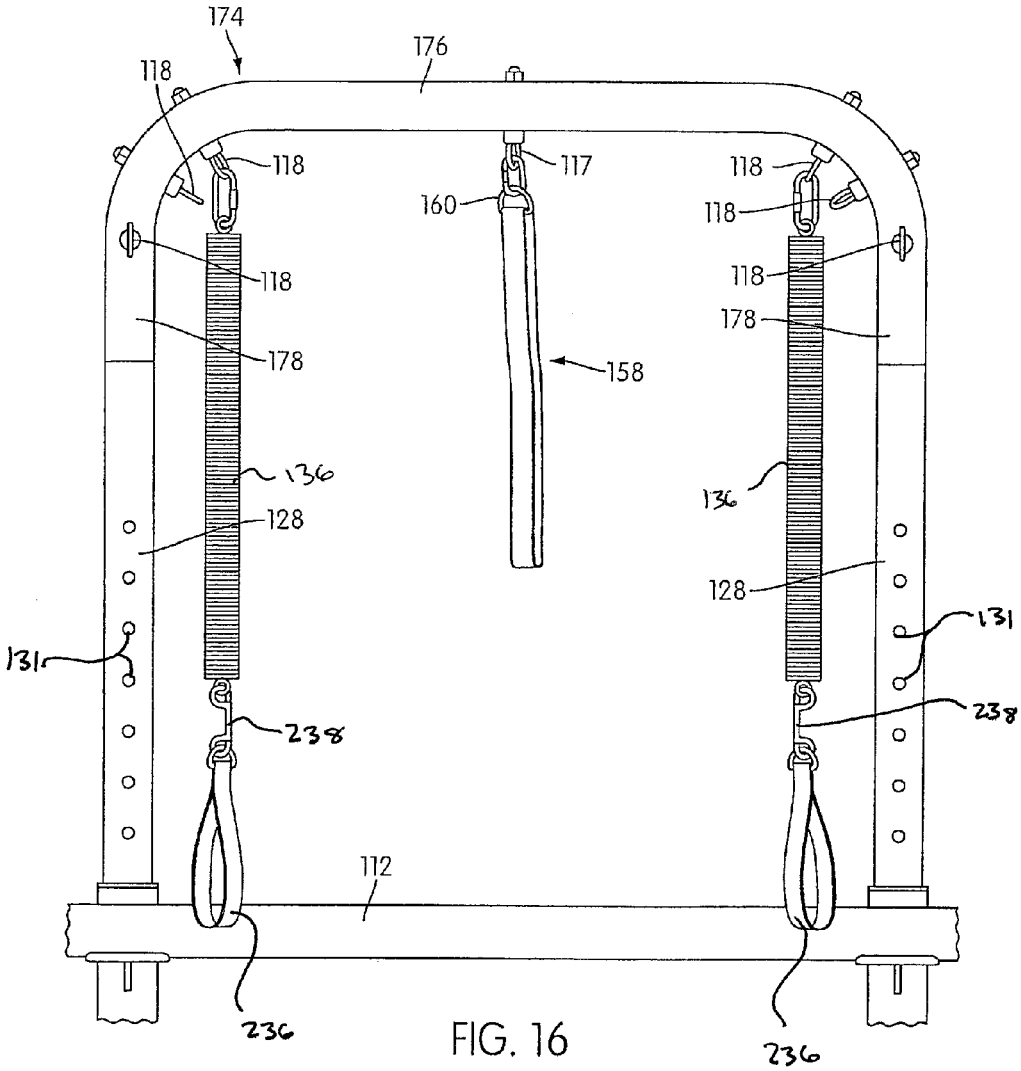
FIG. 16 illustrates a front view of a top of a vertical frame.

FIG. 16 illustrates a front view of a top portion 174 of vertical frame 114. Vertical frame 114 includes two vertical upright members 128 and a horizontal member extending or connected there between side members 178. In the embodiment shown, top portion 174 is generally U-shaped with a horizontal member 176 that runs between side members 178. A plurality of cord brackets 118 are disposed on attachment 174 that enable resistance cords 136 to be removably coupled to attachment 174. Two hand straps 236 are shown attached to cables 136 with clips 238.

Figure 17:
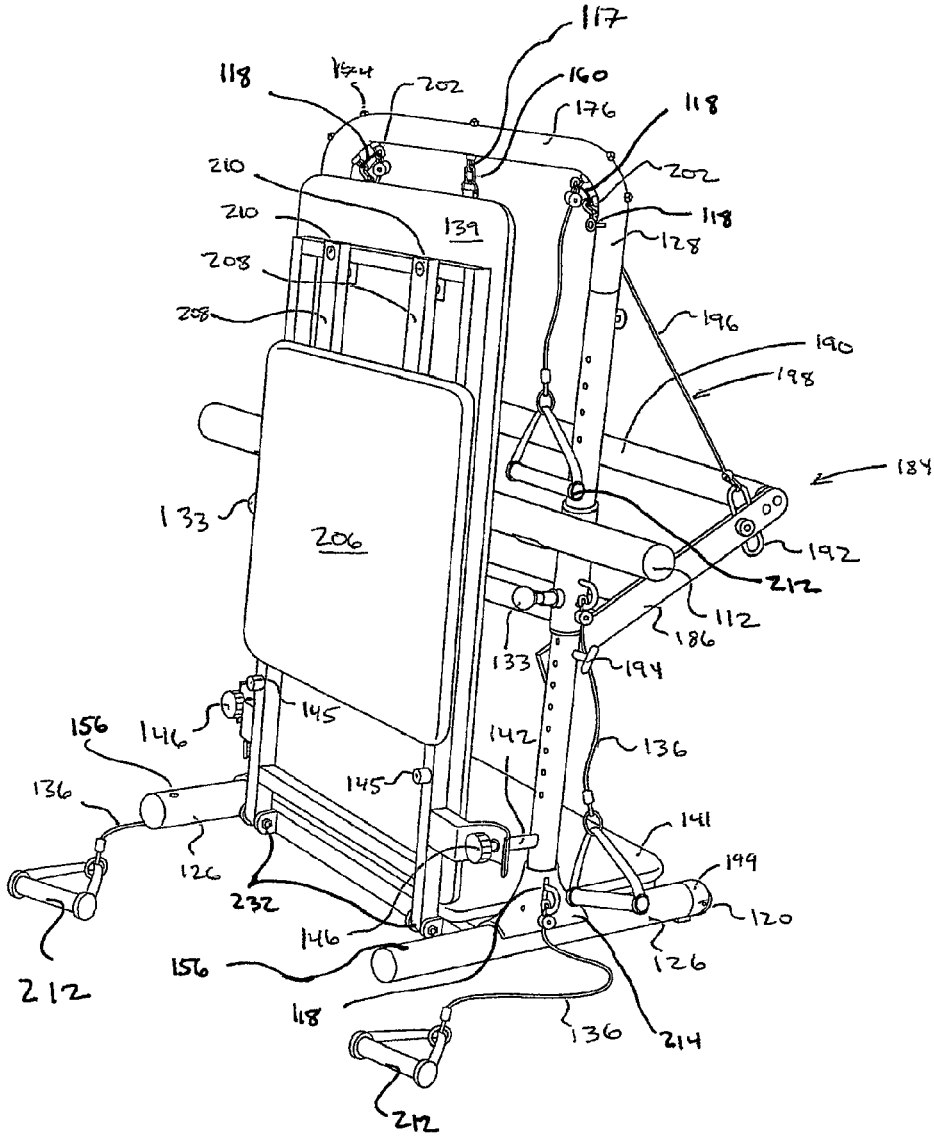
FIG. 17 illustrates a front perspective view of an exercise device in a storage configuration.

FIG. 17 illustrates a front perspective view of exercise device 110 in a storage configuration. Third padded surface 206 is hung off of the bottom portion of first padded surface 132. Frame members 208 are mated with feet 145 of first padded surface 132. To utilize device 110, third padded surface 206 is removed from the bottom portion of first padded surface 132. First padded surface 132 is then lowered into the horizontal position shown in FIG. 1. Third padded surface 206 is then positioned adjacent to first padded surface 132. First padded surface 132 may then be lifted so that frame members 208 extend under first padded surface such that holes 210 mate with feet 145 on first padded surface 132. By having feet 145 of first padded surface 132 extend through holes 210 in frame members 208, third padded surface 206 is attached to first padded surface 132 for performance of exercises by a user.

Figure 18:
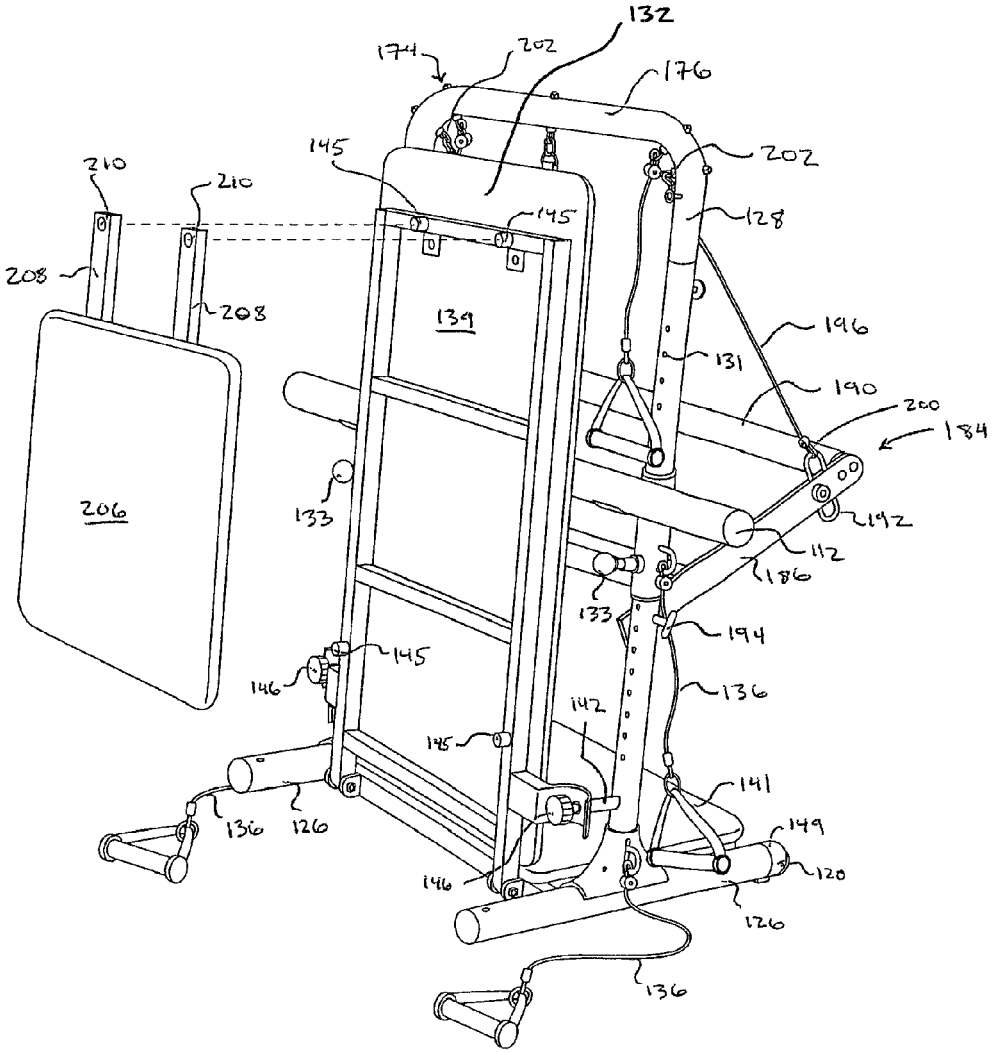
FIG. 18 illustrates an exploded front perspective view of an exercise device in a storage configuration.

FIG. 18 illustrates an exploded front perspective view of exercise device 110 in a storage configuration. Third padded surface 206 is shown removed from first padded surface 132. Dashed lines show how holes 210 formed in frame members 208 mate with feet 145 when first padded surface 132 is in the vertical configuration. Holes 210 also mate with feet 145 when first and third padded surfaces 132 and 206 are in the horizontal configuration to secure third padded surface 206 to first padded surface 132.

While the invention has been shown and described with reference to a particular embodiment thereof, it will be understood to those skilled in the art, that various changes in form and details may be made therein without departing from the spirit and scope of the invention.

What is claimed is:

1. A portable workout apparatus, comprising:

a base;

a pair of vertical members connected to the base and defining a first side and a second side;

padded surface areas disposed on opposite sides of the vertical members, the padded surface areas including a longer pivotable padded structure disposed on the first side of the vertical members, the longer pivotable padded structure being selectively attachable to the base and to at least one of the vertical members, and a shorter padded structure fixed to the base and disposed on the second side of the vertical members;

a removable padded structure removably attached to the longer pivotable padded structure so that the longer pivotable padded structure is positioned between the removable padded structure and the vertical members;

a first horizontal bar adjustably attached to the pair of vertical members so as to be positioned at a selected height on the vertical members on the first side of the vertical members;

a pivot frame pivotally and removeably attached to the pair of vertical members, the pivot frame being configured to be positioned on the vertical members on a second side of the vertical members opposite the first side, the pivot frame including one or more connectors configured to be coupled via one or more resilient members to at least one of the pair of vertical members when the pivot frame is positioned on the second side to support the pivot frame at an angle relative to the pair of vertical members; and a second horizontal bar attached to the pivot frame and pivotally movable therewith.

2. The apparatus of claim 1, wherein the pivotable padded structure is configured to pivot from a horizontal position to a vertical position.

3. The apparatus of claim 1, wherein when the pivotable padded structure is pivoted into the vertical position, the removable padded structure is configured to be positioned vertically and removably attached to the pivotable padded structure.

4. The apparatus of claim 1, wherein the base comprises a pair of wheels configured and arranged to enable rolling movement of the exercise device.

5. The apparatus of claim 1, wherein the pivot frame includes a pair of elongated beams, wherein an opposite end of each of the elongated beams is directly and removably attached to a respective one of the vertical members.

6. A pilates exercise device, comprising:

a pilates tower having a pair of vertical support members and a cross member extending between the vertical support members, the pilates tower having first and second sides;

a first padded surface supported by a first frame extending horizontally from the first side of the pilates tower, the first frame of the first padded surface pivotally mounted to the pilates tower; a second padded surface supported by a second frame extending horizontally from the second side of the pilates tower; and a third padded surface supported by a third frame removeably attached to the first frame at a first location, wherein the third frame is configured to be removeably attached to the exercise device at a second location after it is removed from the first location.

7. The pilates exercise device of claim 6, wherein the first padded surface is positioned between the third padded surface and the vertical members.

8. The pilates exercise device of claim 7, wherein the first padded surface is configured to pivot from a horizontal position to a vertical position where it is removably connected to the pilates tower.

9. The pilates exercise device of claim 8, wherein when the first padded surface is pivoted into the vertical position, the third padded surface is configured to be positioned vertically and attached to the first padded surface.

10. The pilates exercise device of claim 8, further comprising a pivot frame pivotally attached to the pilates tower.

11. An exercise device, comprising:

a pair of vertical support members and a cross member extending between the vertical support members;

a pair of horizontal support members each connected to one of the vertical support members;

a horizontal bar adjustably attached to the vertical support members so as to be positioned at a selected height on the vertical support members;

a first padded surface area supported by a first frame pivotally connected on a first side of the vertical support members and configured to pivot from a horizontal position and a vertical position where it is removeably connected to at least one of the vertical support members; and a second padded surface area supported by a second frame and disposed on a second side of the vertical support members; and a third padded surface supported by a third frame removeably attached to the first frame at a first location, wherein the third frame is configured to be removeably attached to the exercise device at a second location after it is removed from the first location.

12. The exercise device of claim 11, wherein the first padded surface area is positioned between the vertical support members and the third padded surface area.

13. The exercise device of claim 11, further comprising a threaded knob configured to secure the first padded surface to the horizontal support member when the first padded surface is positioned horizontally and to secure the first padded surface to the vertical support member when the first padded surface is positioned vertically.

14. The exercise device of claim 13, further comprising a post that extends from the vertical support member to receive the threaded knob.

15. An exercise device, comprising:

a pair of vertical support members and a cross member extending between the vertical support members;

a pair of horizontal support members each connected to one of the vertical support members;

a horizontal bar adjustably attached to the vertical support members on a first side of the vertical support members so as to be positioned at a selected height on the vertical support members;

a pivot frame pivotally attached to the pair of vertical support members, the pivot frame being positioned on the vertical support members on a second side of the vertical support members opposite the first side;

a first padded surface area pivotally connected on the first side of the vertical support members;

a second padded surface area connected on the second side of the vertical support members;

a third padded surface area configured to be removably attached to the first padded surface area when the first padded surface area is in a horizontal position or in a vertical position, the first padded surface area being positioned between the vertical support members and the third padded surface area;

a fairing joining each horizontal support member to each vertical support member; and a reinforcing rib that reinforces the connection between each of the horizontal and vertical support members, the reinforcing ribs being positioned under, and separate from, the fairings.

16. The exercise device of claim 15, further comprising a threaded knob configured to secure the first padded surface to the horizontal support member when the first padded surface is positioned horizontally and to secure the first padded surface to the vertical support member when the first padded surface is positioned vertically.

17. The exercise device of claim 16, further comprising a post that extends from the vertical support member to receive the threaded knob.

* * * * *